US006915090B2

(12) United States Patent
Fukaya

(10) Patent No.: US 6,915,090 B2
(45) Date of Patent: Jul. 5, 2005

(54) IMAGE FORMING APPARATUS THAT DETERMINES TONER AMOUNT IN A PLURALITY OF COLOR CARTRIDGES

(75) Inventor: Hideaki Fukaya, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/635,612

(22) Filed: Aug. 7, 2003

(65) Prior Publication Data

US 2005/0031367 A1 Feb. 10, 2005

(51) Int. Cl.[7] ..... G03G 15/00; G03G 15/01
(52) U.S. Cl. ..... 399/85; 399/28; 399/82
(58) Field of Search ..... 399/27, 28, 29, 399/53, 54, 82, 83, 85

(56) References Cited

U.S. PATENT DOCUMENTS 6,029,018 A 2/2000 Rogers, IV et al.
6,266,493 B1 * 7/2001 Farrell et al. ..... 399/27 X
6,285,843 B1 * 9/2001 Obata ..... 399/82
6,314,250 B1 * 11/2001 Miyashiro ..... 399/27
6,463,224 B1 * 10/2002 Phillips ..... 399/27
6,738,587 B1 * 5/2004 Hoene et al. ..... 399/82 X

FOREIGN PATENT DOCUMENTS

JP 2001-016375 A 1/2001

* cited by examiner

*Primary Examiner*—Sandra L. Brase
(74) *Attorney, Agent, or Firm*—Foley & Lardner LLP

(57) ABSTRACT

An image forming apparatus is provided including at least one color cartridge that supplies at least one color toner, a monochrome cartridge that supplies monochrome toner, an image formation unit configured to form an image on an image-transferring member using at least one of the at least one color toner and the monochrome toner, and a processor electrically coupled to the image formation unit. The processor is configured to: determine whether the at least one color cartridge contains insufficient color toner for printing an image according to a first image job, queue a second image job not requiring the at least one color cartridge before the first image job requiring the at least one color cartridge if the at least one color cartridge contains insufficient color toner for printing the image of the first image job, and control the image formation unit to form images in accordance with the queue.

4 Claims, 5 Drawing Sheets

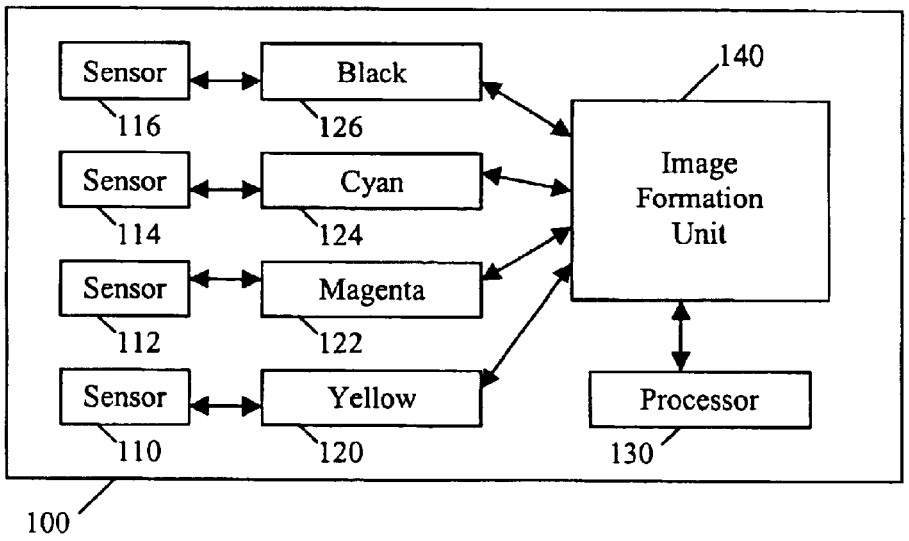
Figure 2
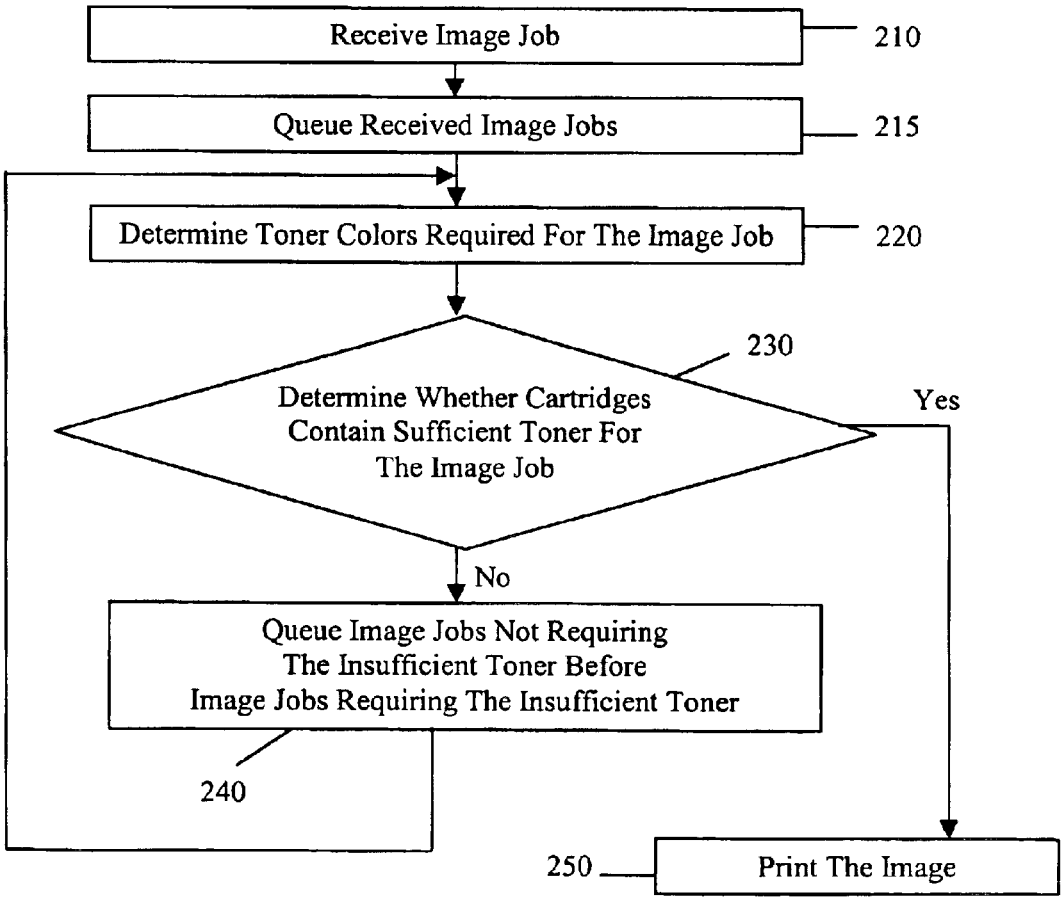

IMAGE FORMING APPARATUS THAT DETERMINES TONER AMOUNT IN A PLURALITY OF COLOR CARTRIDGES

BACKGROUND OF THE INVENTION

A. Field of the Invention

The invention relates generally to image forming apparatuses such as photocopiers, facsimile machines, and printers, and more particularly to a method and apparatus for printing images when at least one of a plurality of color cartridges contains an insufficient amount of toner for printing an image.

B. Background of the Invention

Photocopiers, facsimile machines, and laser printers for printing images with a color toner are known. Examples of such devices are described in U.S. Pat. No. 6,029,018 and Japanese Patent Publication No. JP 2001-16375, both of which are incorporated by reference herein in their entirety.

In many conventional color laser printers, all of four toner cartridges (cyan, magenta, yellow, and black/monochrome) must be installed and available for the printer to be operable. If one or more of the toner cartridges are either not installed or has an insufficient supply of toner, an error message is generated and the printer will not operate until the problem is addressed. If one or more of the color cartridges is nonfunctional, the error message can prevent printing by a user wanting to print only monochrome images using the monochrome toner cartridge, which is installed and fully operable.

Thus, a need exists for a method and apparatus for printing images when one or more of the color cartridges contains an insufficient amount of toner for printing an image.

SUMMARY OF THE INVENTION

According to one embodiment of the present invention, an image forming apparatus is provided, including at least one color cartridge that supplies at least one color toner, a monochrome cartridge that supplies monochrome toner, an image formation unit configured to form an image on an image-transferring member using at least one of the at least one color toner and the monochrome toner, and a processor electrically coupled to the image formation unit. According to this embodiment, the processor is configured to determine whether the at least one color cartridge contains insufficient color toner for printing an image according to a first image job, queue a second image job, the second image job not requiring the at least one color cartridge, before the first image job requiring the at least one color cartridge if the at least one color cartridge contains insufficient color toner for printing the image of the first image job, and control the image formation unit to form images in accordance with the queue.

According to another embodiment of the present invention, a method of forming images on an image-transferring member is provided, including providing at least one color cartridge that supplies at least one color toner, providing at least one monochrome cartridge that supplies monochrome toner, determining whether the at least one color cartridge contains insufficient color toner for printing an image according to a first image job, queuing a second image job, the second image job not requiring the at least one color cartridge, before the first image job requiring the at least one color cartridge if the at least one color cartridge contains insufficient color toner for printing the image of the first job, and forming an image according to the queuing.

According to another embodiment of the present invention, an image forming apparatus is provided, including at least one color cartridge means that supplies at least one color toner, a monochrome cartridge means that supplies monochrome toner, an image forming means for forming an image on an image-transferring member using at least one of the at least one color toner and the monochrome toner, a processing means electrically coupled to the image forming means, and means for controlling the image forming means for forming images in accordance with the queue. The processing means is configured for determining whether the at least one color cartridge means contains insufficient color toner for printing an image according to a first image job, and for queuing a second image job, the second image job not requiring the at least one color cartridge means, before the first image job requiting the at least one color cartridge means if the at least one color cartridge means contains insufficient color toner for printing the image of the first image job.

Further features, aspects and advantages of the present invention will become apparent from the detailed description of preferred embodiments that follows, when considered together with the accompanying drawing figures:

BRIEF DESCRIPTION OF THE DRAWINGS

FIG. 1 is a block diagram of an exemplary image forming apparatus for carrying out embodiments of the present invention.

FIG. 2 shows a flow chart of a method according to a first embodiment of the invention.

DETAILED DESCRIPTION OF EXEMPLARY EMBODIMENTS

Figure 3:
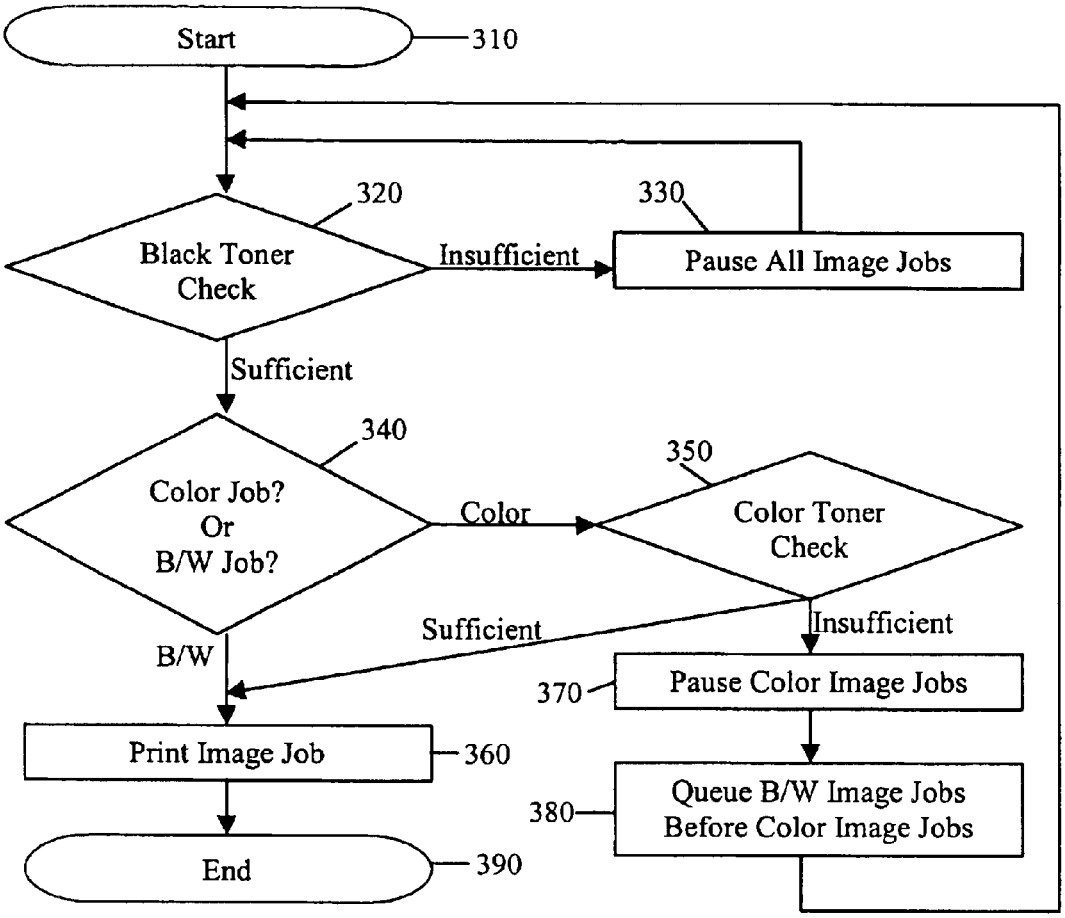
FIG. 3 shows a flow diagram chart of a method according to a second embodiment of the invention.

Reference will now be made in detail to presently preferred embodiments of the invention. Wherever possible, the same reference numbers will be used throughout the drawings to refer to the same or like parts. Additionally, it should be appreciated that the method steps described in the following exemplary embodiments can be performed by appropriately programming processor 130 shown in FIG. 1, or by implementation of additional components such as application specific integrated circuits (ASIC), or other known components that can process the methods as described below.

An exemplary image forming apparatus 100 is shown in FIG. 1. The image forming apparatus 100 includes an image formation unit 140 (e.g., a laser or inkjet printing mechanism), a processor 130 electrically coupled to image formation unit 140, and a plurality of toner cartridges 120, 122, 124, and 126 for supplying toner to image formation unit 140. While only four cartridges 120 (yellow), 122 (magenta), 124 (cyan), and 126 (monochrome/black) are shown, it should be appreciated that more or less cartridges may be used depending on the particular implementation.

Additionally, the cartridges 120, 122, 124, and 126 may be implemented as distinct replaceable and/or refillable cartridges, or as an integrated unit/units, such as a combined color cartridge unit and monochrome/black unit. The term "cartridge" in the present context is intended to cover any of the alternatives.

As shown, the image forming apparatus 100 also includes one or more sensors 110, 112, 114, and 116 (e.g., optical and/or magnetic sensors) for determining when a toner level within cartridge 120, 122, 124, or 126 respectively falls below a level sufficient for printing an image according to a particular image job. In this regard, the sensors 110, 112, 114, and 116 may detect an actual toner amount (e.g., 10% full, 20% full, 30% full, etc.), or detect when a minimum toner amount/threshold level remains (e.g., about empty). Further a single sensor unit may be used for detecting the toner levels of more than one cartridge. The sensors 110, 112, 114, 116 provide their outputs to the processor 130.

If an actual amount of toner is detected, the processor 130 can estimate the amount of toner needed for a given image job, and compare the estimated amount required to that available in cartridges 120, 122, 124, and 126. By way of example, a first image job and a second image job which both require a particular toner color (e.g., cyan) may require a different amount of that particular toner, so that sufficient toner exists in cartridge 124 for the second image job, but not the first image job. Such a situation can be dealt with by imaging only the second image job, without imaging the first image job.

Figure 5A:
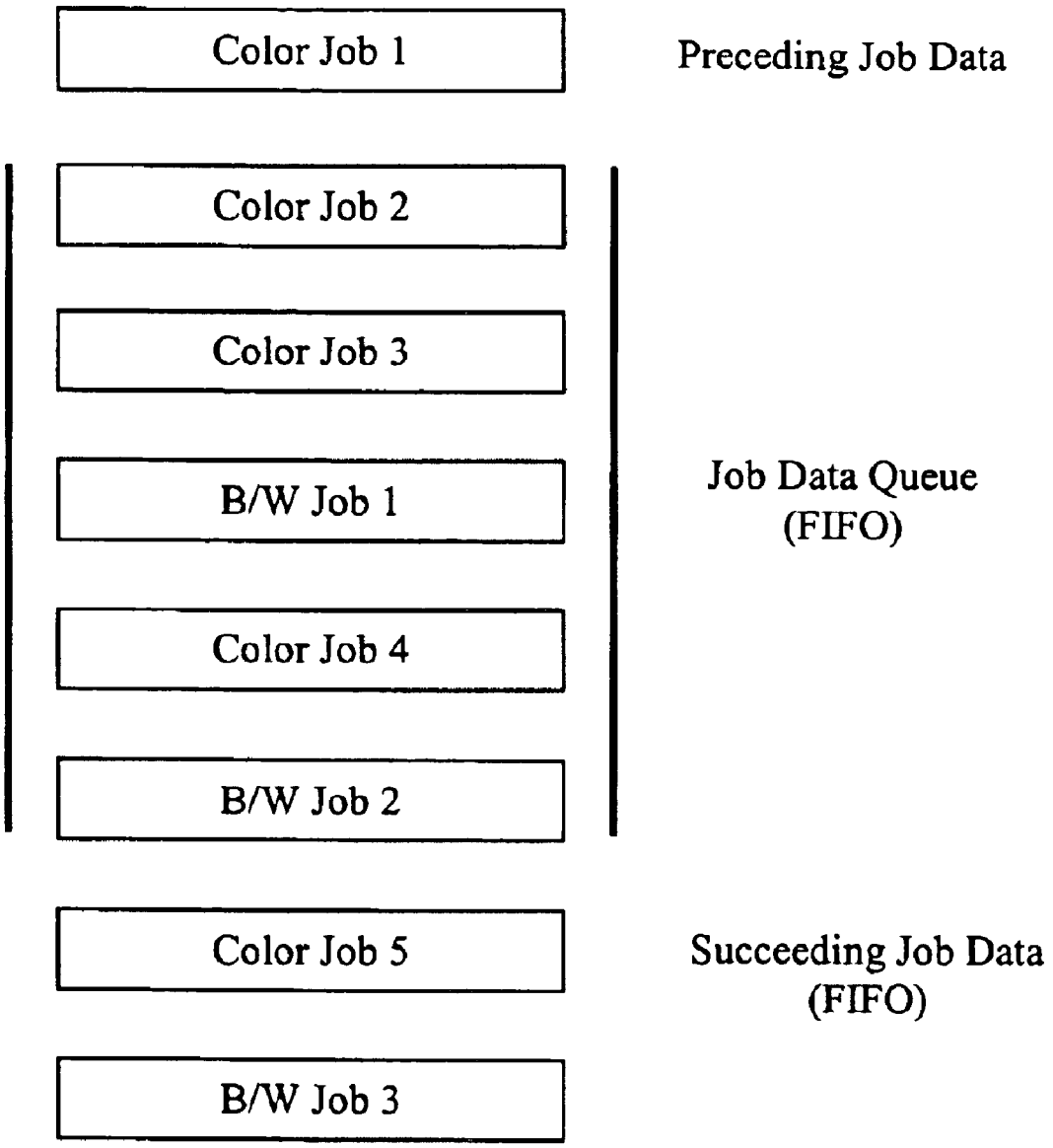
FIG. 5A shows an exemplary queue when an image forming apparatus detects a color toner amount at an insufficient level to print a color image.

FIG. 2 shows a flow chart for operating the image forming apparatus 100 according to one embodiment of the present invention. In step 210, the image forming apparatus 100 receives an image job and places it in a queue of received image jobs in step 215. FIG. 5A contains an exemplary queue. By way of example, if the image forming apparatus 100 is a photocopier, a user may place a color document in a scanning mechanism thereon and initiate a photocopy on the image forming apparatus 100, thereby generating an image job, which is queued in step 215.

When a given image is the next image to be printed (i.e., "next in line"within the queue) the image forming apparatus 100 determines the toner colors (e.g., black, cyan, magenta, and yellow) required for printing the image in step 220. With this determination, in step 230, the image forming apparatus 100 determines whether cartridges 120, 122, 124, and 126 contain sufficient toner for the image job. Sensors 110, 112, 114, and 116 may transmit a signal to processor 130 indicative of toner levels in cartridges 120, 122, 124, and 126 respectively, or may transmit an abnormal signal to processor 130 only when a toner level within cartridges 120, 122, 124, and 126 is below a predetermined minimum level. With the latter method, no need for constant querying of the toner levels exists.

Figure 5B:
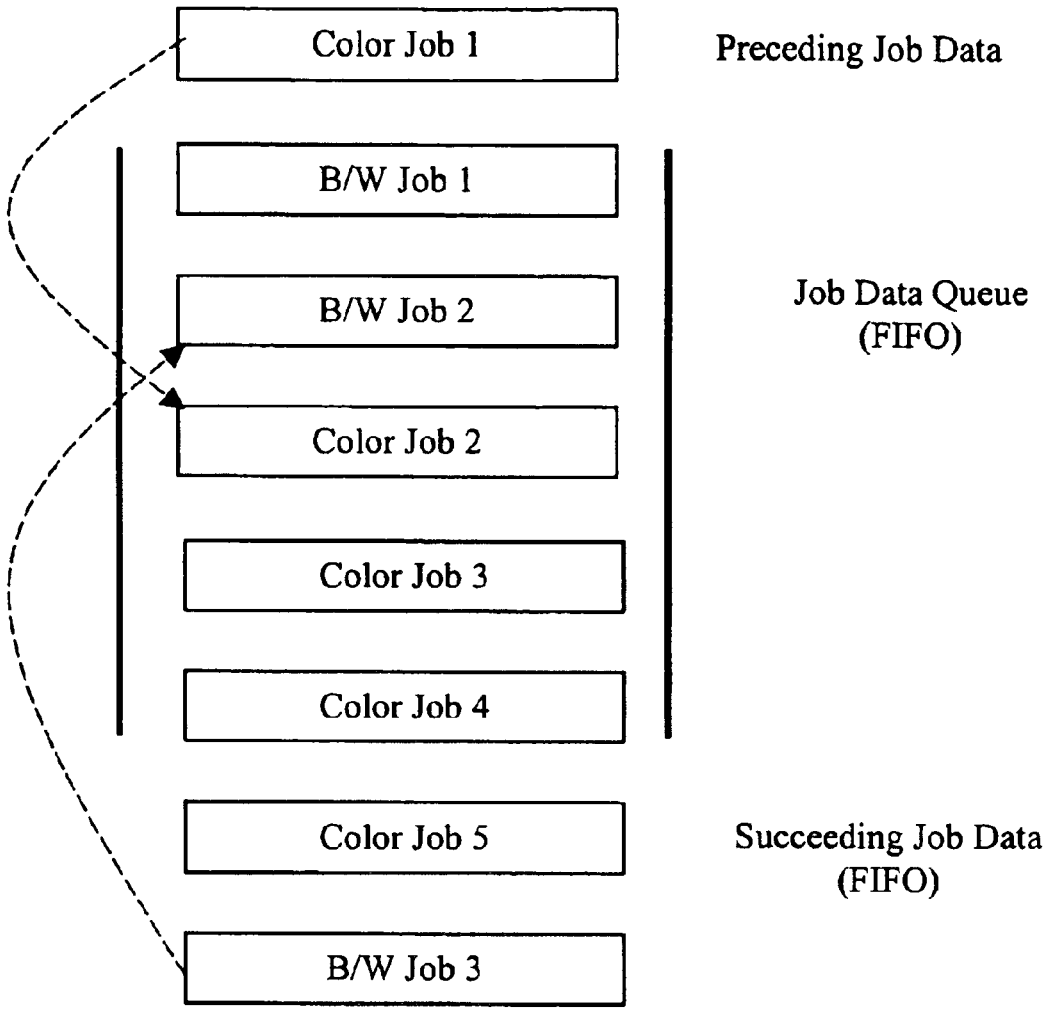
FIG. 5B shows the re-queued queue of FIG. 5A in response to the detection of an insufficient toner level.

If the cartridges 120, 122, 124, and 126 contain sufficient toner for printing the image, the image forming apparatus 100 proceeds with printing the image in step 250. However, if in step 230 the image forming apparatus 100 determines that one or more cartridges 120, 122, 124, and 126 do not contain sufficient toner to print the image, then in step 240, the image forming apparatus 100 re-queues image jobs to order them such that the image jobs for which sufficient toner exists are moved ahead of those image jobs requiring the insufficient toner. An exemplary re-queuing is shown in FIG. 5B. By way of example, the image forming apparatus 100 may queue black-and-white/monochrome (B/W) image jobs before color image jobs, if one or more of the color cartridges 120, 122, and/or 124 do not contain sufficient toner for printing a color image. The image jobs for which sufficient toner exists are printed. The re-queuing may be done for just one image job at a time, and checked for sufficient toner after printing each such one image job. In the alternative, multiple image jobs, up to the entire list of queued image jobs, can be reshuffled according to the available toner at that point based on achieving the highest number of image jobs with the present toner available.

One particular application of the method of FIG. 2 is that when one or more color cartridges are insufficient for printing a color image job, then the black-and-white image job(s) is moved ahead in the queue and printed (i.e., without waiting for the color cartridges to be replaced).

With the method of FIG. 2, an image forming apparatus can continue printing images that do not require a toner which is at an insufficient level (e.g., empty toner, inoperative/unavailable cartridge, etc.), while preserving the image jobs that do require the toner at an insufficient level for future printing once the toner level has been increased (e.g., replacing an empty cartridge, etc.).

FIG. 3 shows a flow chart for carrying out a method of a second embodiment of the present invention. In step 310, the image forming process starts; e.g., by performing steps similar to steps 210 and/or 215 of FIG. 2. In step 320, the image forming apparatus 100 then checks only the black/monochrome toner level in the black/monochrome toner cartridge 126.

If the black toner check in step 320 determines that there is an insufficient amount of toner available for printing an image, the image forming apparatus 100 then pauses all image jobs in step 330. Preferably, the image forming apparatus then repeatedly performs step 320 until the black toner has returned to a sufficient level (e.g., by a user refilling cartridge 126).

If black toner exists at step 320 for printing the next image in the queue, then in step 340, the image forming apparatus 100 then checks whether the next image job in the queue is a color image job or a black-and-white image job. If the next image job is a black-and-white image job, the image job is printed in step 360, and ends the printing process in step 390. At step 390, the printer may be returned to an idle condition waiting for a next image job to be received, or return to step 310 if additional image jobs are present in the queue.

If in step 340, the next image job is a color image job, then in step 350, the apparatus checks the color toner level(s) of cartridges 120, 122, and 124. If sufficient color toner is available for printing the next image job, it then prints the image job in step 360 and ends the printing process in step 390 (where the printer is returned to the idling condition or the method returns to step 310).

However, in step 350, if an insufficient amount of toner exists to print the next image job, the image forming apparatus 100 pauses color image jobs in step 370. By way of example, the image forming apparatus 100 may pause all color image jobs in step 370, only color image jobs that require the particular color toner (cyan, magenta, yellow) which has been determined to be of an insufficient quantity, or only color image jobs that require an amount of color toner greater than the level detected by sensor(s) 110, 112, and/or 114. The image forming apparatus 100 then queues image jobs not paused in step 370 before the paused image jobs in step 380. As a particular example, the apparatus may pause all color printing, and proceed with printing only the black-and-white images.

In this manner, the image forming apparatus 100 can continue printing some image jobs even though one or more color cartridges 120, 122, and 124 has an insufficient amount of toner available for other image jobs. The image forming apparatus 100 discern between color vs. black-and-white image jobs, or between two different color image jobs where one color job cannot be printed with the available toner while the other one can.

Figure 4:
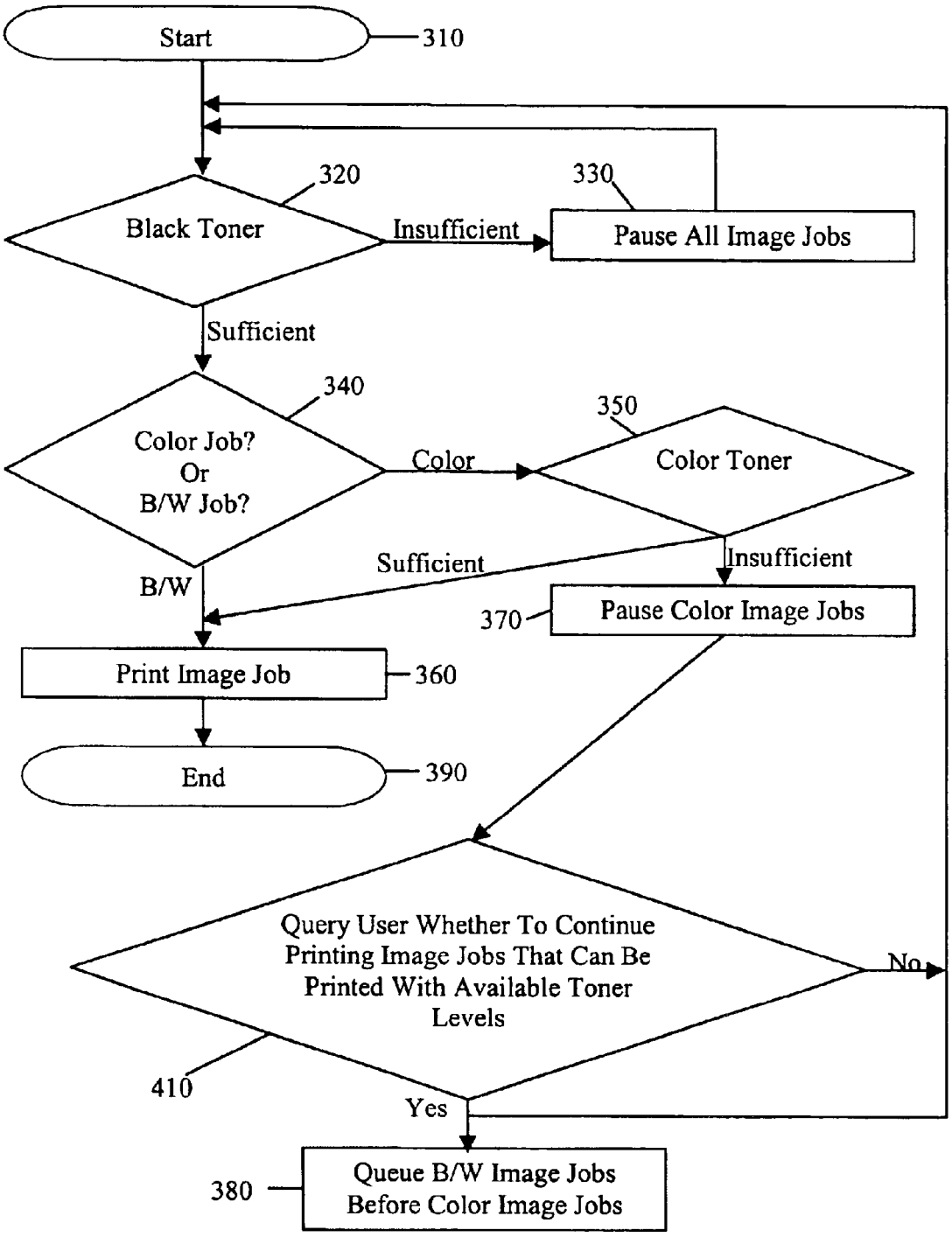
FIG. 4 shows a flow diagram chart of a method according to a third embodiment of the invention.

FIG. 4 shows a flow chart for a method according to a third embodiment of the present invention. The embodiment, of FIG. 4 is analogous to that shown in FIG. 3, except that the image forming apparatus 100 queries a user whether to continue printing image jobs that can be printed with the available toner before re-queuing the image jobs.

More specifically, in this embodiment, the user is queried in step 410 whether to print image jobs that can be printed with the available toner. If the user gives a positive input (or no input within a specified time period) the queue is adjusted in step 380. In this manner, a user may choose not to disturb the queue; e.g., when the user has a high priority for the next image job and is about to refill the cartridge. In addition, the user may be given the choice to print the color image jobs in black-and-white, to avoid the waiting time or the re-queuing moving the color image job back.

An image forming apparatus 100 operated in this manner provides a user with greater control of the printing function, while allowing the image forming apparatus 100 to continue printing images that can be printed with available toner, thereby increasing the functionality of the image forming apparatus.

FIG. 5A illustrates an exemplary queue according to an embodiment that can be used with the methods described above. FIG. 5A, depicts the queue when image forming apparatus 100 detects a color toner amount at an insufficient level to print a color image. As shown, Color Job 1 is currently being imaged, five image jobs (Color Job 2, Color Job 3, Color Job 4, B/W Job 1, and B/W Job 2) are pending in a first-in-first-out (FIFO) buffer, and two Succeeding Jobs (Color Job 5, and B/W Job 3) will be received in the future. At this point, the image forming apparatus 100 detects a color cartridge 120, 122, and/or 124 with an insufficient amount of toner to image Color Job 1 (e.g., step 230 or step 350).

Once the insufficient amount of toner has been detected, the image forming apparatus 100 stops Color Job 1, and notifies a user that the detected cartridge 120, 122, and/or 124 requires service (e.g., refilling, replacement or the like). The image forming apparatus 100 then re-queues the job data in the queue into B/W priority as shown in FIG. 5B, where all black-and-white jobs are moved to the front of the FIFO. The black-and-white jobs are printed ahead of preceding color jobs. Succeeding Color Jobs (e.g., Color Job 5) may then automatically be queued behind the B/W Jobs. As an alternative, succeeding B/W Jobs (e.g., B/W Job 3) may then be automatically queued before the Color Jobs if the detected color cartridge 120, 122, and/or 124 is not serviced prior to receipt thereof.

In this manner, the queue may be re-queued as previously described in reference to the embodiments of FIGS. 2–4, providing improved image forming apparatus control over conventional printers. Other configurations are also plausible, as would be readily apparent to one of ordinary skill in the art after reading this disclosure.

The foregoing description of preferred embodiments of the invention has been presented for purposes of illustration and description. It is not intended to be exhaustive or to limit the invention to the precise form disclosed, and modifications and variations are possible in light in the above teachings or may be acquired from practice of the invention. The aspects of the embodiments may be combined with one another. The embodiments were chosen and described in order to explain the principles of the invention and a practical application to enable one skilled in the art to utilize the invention in various embodiments and with various modifications are suited to the particular use contemplated. By way of example, various method steps described may be combined in whole or in part, may be rearranged in order of performance, and/or may be omitted in some applications. Moreover, additional steps may be provided, such as notifying a user when one or more of cartridges 120, 122, 124, and/or 126 is running low on toner, and/or continuously checking a toner level while printing an image job in step 250 and/or step 360. It is intended that the scope of the invention be defined by the claims appended hereto and their equivalents.

What is claimed is:

1. An image forming apparatus, comprising:

a plurality of color cartridges, each of the color cartridges supplying a color toner;

a monochrome cartridge that supplies monochrome toner;

an image formation unit configured to form an image on an image-transferring member using at least one of the plurality of color toners and the monochrome toner; and a processor electrically coupled to the image formation unit, the processor configured to:

determine whether the plurality of color cartridges contain insufficient color toner for printing an image according to a first image job;

queue a second image job, the second image job not requiring the plurality of color cartridges, before the first image job requiring the plurality of color cartridges if the plurality of color cartridges contain insufficient color toner for printing the image of the first image job; and control the image formation unit to form images in accordance with the queue, wherein the processor is configured to determine whether at least one of the plurality of color cartridges contains insufficient color toner for printing the image according to the first image job, and to queue the second image job not requiring the at least one of the plurality of color cartridges before the first image job, and the processor is further programmed to query a user whether to continue printing image jobs not requiring the at least one of the plurality of color cartridges, and wherein the processor is programmed to control the image formation unit so as to continue printing image jobs not requiring the at least one of the plurality of color cartridges if the user query is positive.

2. The image forming apparatus of claim 1, wherein the processor is further programmed to pause all image jobs if the user query is negative.

3. An image forming apparatus comprising:

at least one color cartridge that supplies at least one color toner;

a monochrome cartridge that supplies monochrome toner;

an image formation unit configured to form an image on an image-transferring member using at least one of the at least one color toner and the monochrome toner; and a processor electrically coupled to the image formation unit, the processor configured to:

determine whether the at least one color cartridge contains insufficient color toner for printing an image according to a first image job;

queue a second image job, the second image job not requiring the at least one color cartridge, before the first image job requiring the at least one color cartridge if the at least one color cartridge contains insufficient color toner for printing the image of the first image job;

control the image formation unit to form images in accordance with the queue;

query a user whether to continue printing images in monochrome that require a color toner determined to be insufficient for printing an image, and control the image formation unit so as to continue printing images in monochrome that require the color toner determined to be insufficient for printing an image if the user query is positive.

4. A method of forming images on an image transferring member, comprising:

providing at least one color cartridge that supplies at least one color toner;

providing at least one monochrome cartridge that supplies monochrome toner;

determining whether the at least one color cartridge contains insufficient color toner for printing an image according to a first image job; queuing a second image job, the second image job not requiring the at least one color cartridge, before the first image job requiring the at least one color cartridge if the at least one color cartridge contains insufficient color toner for printing the image of the first job;

forming an image according to the queuing;

query a user whether to continue printing image jobs not requiring the at least one of the plurality of color cartridges;

printing at least one image job not requiring the at least one of the plurality of color cartridges if the user query is positive; and pausing all image jobs if the user query is negative until the one of the plurality of colorants is refilled.

* * * * *